US006178301B1

(12) United States Patent
Kojima et al.

(10) Patent No.: US 6,178,301 B1
(45) Date of Patent: Jan. 23, 2001

(54) CLEANING APPARATUS FOR CLEANING AN IMAGE CARRIER, PROCESS CARTRIDGE HAVING A CLEANING APPARATUS FOR REMOVING REMAINING DEVELOPER ON AN IMAGE CARRIER, AND IMAGE FORMING APPARATUS HAVING A CLEANING MEMBER FOR REMOVING REMAINING DEVELOPER ON AN IMAGE CARRIER

(75) Inventors: Hisayoshi Kojima, Mishima; Kazunari Murayama, Shizuoka-ken; Tomonori Mori, Numazu, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/382,391

(22) Filed: Aug. 25, 1999

(30) Foreign Application Priority Data

Aug. 26, 1998 (JP) ..... 10-239922

(51) Int. Cl.[7] ..... G03G 21/00
(52) U.S. Cl. ..... 399/98; 399/102
(58) Field of Search ..... 399/98, 99, 102, 399/111, 119

(56) References Cited

U.S. PATENT DOCUMENTS 5,740,500 * 4/1998 Hashimoto ..... 399/114
5,774,765 * 6/1998 Hirota et al. ..... 399/102

FOREIGN PATENT DOCUMENTS 1-177065 * 7/1989 (JP) .
4-174885 * 6/1992 (JP) .
7-334056 * 12/1996 (JP) .
10-222036 * 8/1998 (JP) .

* cited by examiner

*Primary Examiner*—Joan Pendegrass
(74) *Attorney, Agent, or Firm*—Fitzpatrick, Cella, Harper & Scinto

(57) ABSTRACT

A cleaning apparatus for an image carrier includes a cleaning member for removing remaining developer left on the image carrier; and a sealing member disposed on each opposite end of the cleaning means for preventing the developer removed by the cleaning member from leaking out. The sealing member cleans a surface to which a distance-ensuring device for maintaining a prescribed distance between the image carrier and another electrophotographic process means, extends, and contacts with the image carrier.

6 Claims, 4 Drawing Sheets

CLEANING APPARATUS FOR CLEANING AN IMAGE CARRIER, PROCESS CARTRIDGE HAVING A CLEANING APPARATUS FOR REMOVING REMAINING DEVELOPER ON AN IMAGE CARRIER, AND IMAGE FORMING APPARATUS HAVING A CLEANING MEMBER FOR REMOVING REMAINING DEVELOPER ON AN IMAGE CARRIER

BACKGROUND OF THE INVENTION

1. Field of the Invention

This invention relates to a process cartridge using an electrophotographic method or an electrostatic recording method and an image forming apparatus using the process cartridge.

2. Description of Related Art

To form images, image forming apparatuses using an electrophotographic method or an electrostatic recording method form, by selective exposure, latent images on an image carrier, uniformly charged, serving as an electrophotographic photosensitive body by a charging means, visualize the latent images by a developing means, and transfer the developed images onto a recording medium. After the developed images are transferred, remaining developer (hereinafter referred to as "waste toners") left on the image carrier is cleaned by a cleaning means and reused for image formation upon being charged uniformly.

A process cartridge has been practically used recently in which process means, such as charging means, developing means, cleaning means, a cleaning container, and so on, are made in a united structure. A user can replace the parts, such as the developers, the image carrier, and so on with those by placing the process cartridge in the apparatus body, thereby rendering the maintenance easier.

Since the image carrier generally has extended the life time of the carrier, recently favored usage, which renders the maintenance easier and corresponds to life times of the essential parts is done by designing a developing means, having some limitation for supplying capability, into an independent cartridge and by designing the remaining process means, such as an image carrier, a charger, a cleaning means, and so on, into a drum cartridge, in a united body.

FIG. 4 shows an example of a conventional process cartridge. The process cartridge 100 shown in FIG. 4 is the above drum cartridge, which includes an image carrier 101, a cleaner blade 102 serving as a cleaning means, and a cleaning container 104 accumulating the waste toners.

The cleaner blade 102 has an elastic contact portion 102*a* supported by a support member 102*b* in contact with the image carrier 101 and removes the waste toner remaining on the surface of the image carrier 101. A sealing member 103 made of a material such as mortoprain, sponge, felt, or the like is provided on the opposite ends of the cleaner blade 102 to prevent the waste toner from leaking out of the cleaning container 104. The cleaning container 104 has a volume capable of adequately containing waste toner occurring at the cleaner blade 102 within the life time of the image carrier 101, and can be removed at the time of replacement of the drum cartridge.

Particularly, in a case of a development method using a jumping development or magnetic brush development, it is important to position a developer carrier (development sleeve) for developing images with high accuracy at a prescribed distance with respect to the image carrier 101. Therefore, a contacting roller 105 or the like as a distance ensuring means manufactured with high accuracy is generally placed on each end of the image carrier to ensure the proper distance between the image carrier 101 and the development sleeve (not shown).

In such a case, if the contacting surface 101*a* of the contacting roller 105 on the image carrier 101 becomes dirty with scattered toner, the toner may adhere to the contacting surface 1O1*a*, and the prescribed distance may not be kept, disadvantageously. Therefore, the placement of a cleaning member 106, as a part separated from the sealing member 103 provided on the opposite ends of the cleaner blade 102, has been implemented recently for cleaning the contacting surface 101*a* of the contacting roller 105.

Where the sealing member 103 and the cleaning member 106 are separated members, as shown in the apparatus in FIG. 4, however, developers may accumulate on unclean areas particularly in the process cartridge having a longer life time because the space between those members 103, 106 cannot be cleaned, and the accumulated developers may drop into the apparatus body to disadvantageously make the apparatus inside dirty.

It is therefore an object of the invention to provide a cleaning apparatus, a process cartridge, and an image forming apparatus reducing the uncleanness inside the apparatus by proposing a cleaning method for the surface of the image carrier having no unclean area.

SUMMARY OF THE INVENTION

To solve the above problems, a representative structure of the cleaning apparatus, according to the invention, includes a cleaning member for removing a remaining developer left on the image carrier, and a sealing member disposed on each opposite end of the cleaning means for preventing the developer removed by the cleaning means from leaking out, the sealing member cleaning a surface to which a distance-ensuring means, for maintaining a prescribed distance between the image carrier and another electrophotographic process means, extends and contacting the image carrier.

Since the sealing member that is provided on each opposite end of the cleaning means is extended to a surface on the image carrier contacting the distance-ensuring means for cleaning the surface, the process cartridge can eliminate an area at which scattered toner arrives, so that the process cartridge can reduce the uncleanness inside the apparatus. Because the members are made in a united body, the number of parts is reduced, and the manufacturing process and the cost of parts of the cleaning apparatus can be reduced, so that the productivity can be improved.

DESCRIPTION OF PREFERRED EMBODIMENTS

Figure 1:
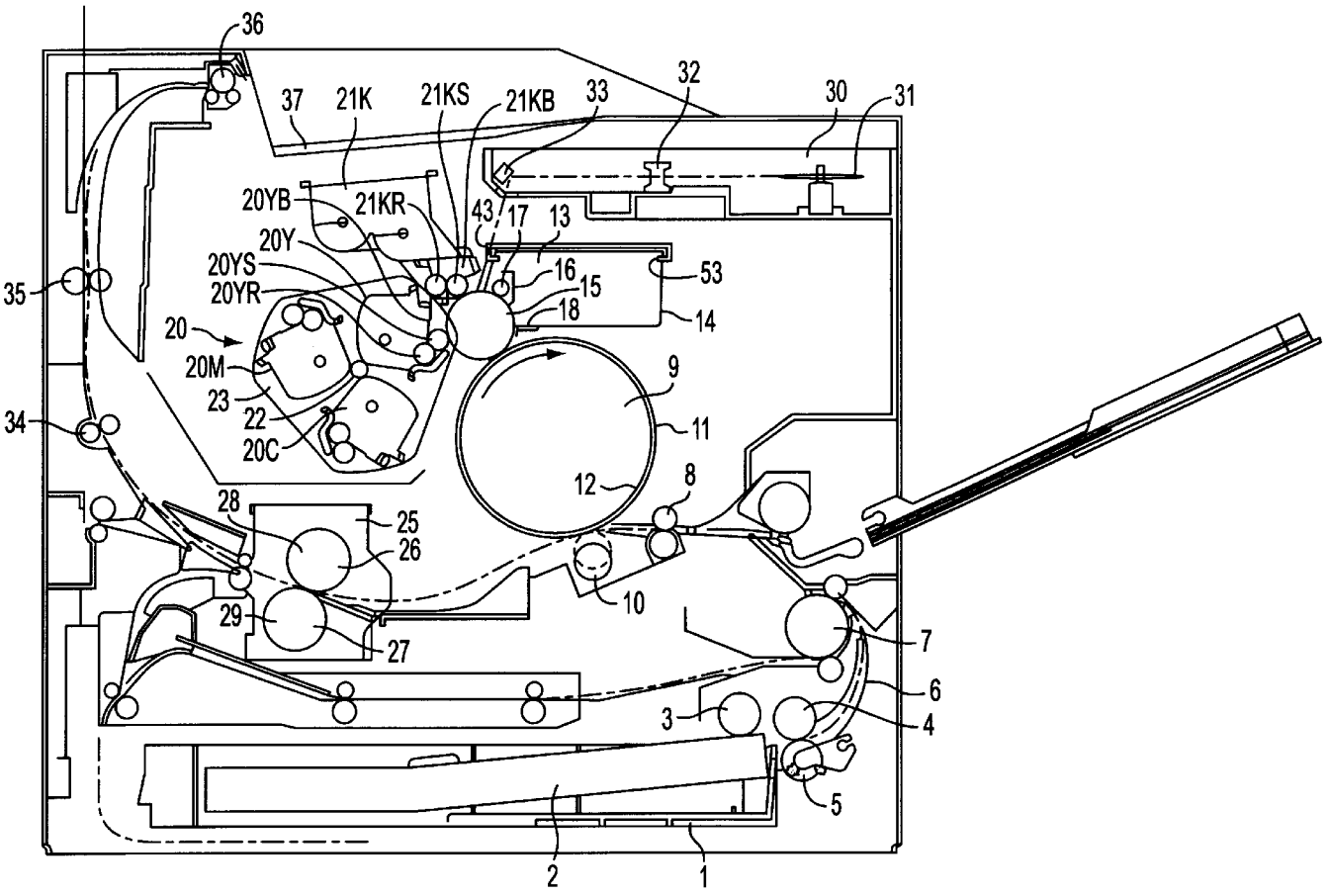
FIG. 1 is an entire structural view showing an image forming apparatus according to an embodiment of the invention.
Figure 2:
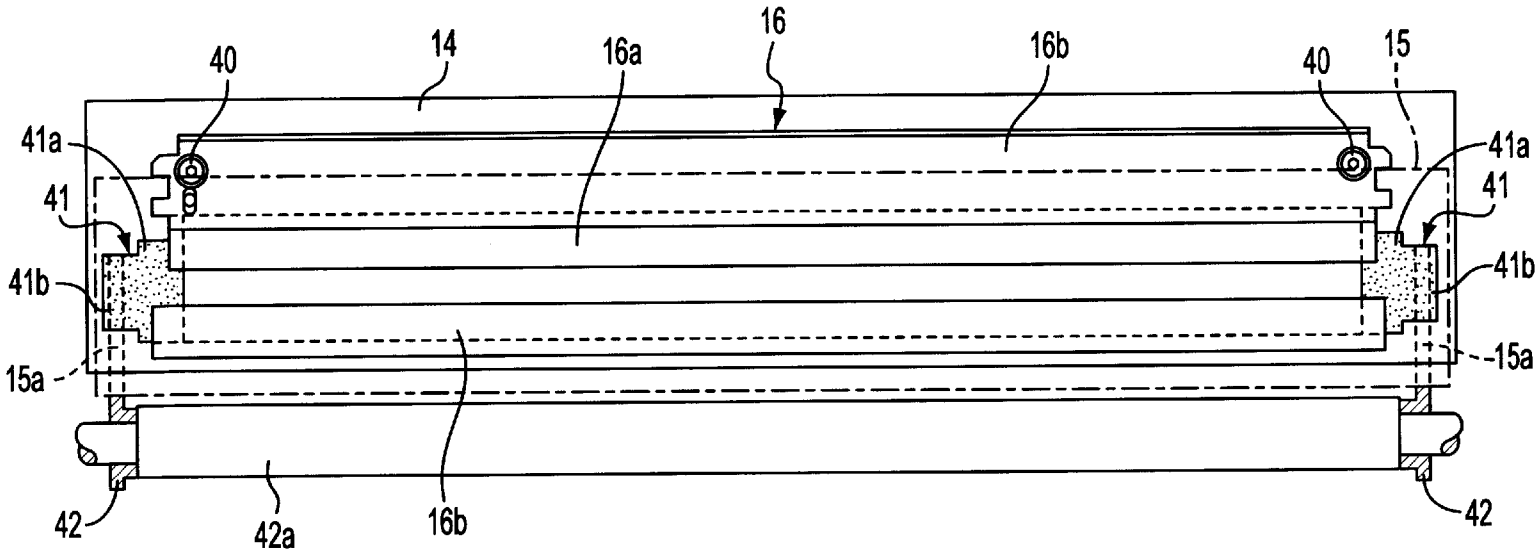
FIG. 2 is a front view showing a process cartridge according to an embodiment of the invention.

Referring to FIGS. 1, 2, a process cartridge and an image forming apparatus of embodiments according to the invention are described.

[Whole Structure]

The image forming apparatus 1 shown in FIG. 1 is a color laser printer. As shown in FIG. 1, the image forming apparatus includes an image carrier 15 rotating at a fixed rate, an image forming section made of a secured black developing unit 21K and a rotary developing unit 20 having three color developing units, an intermediate transfer body 9 for holding color images developed and overlapped at the image forming section and transferring the images onto a recording medium S fed from a feeding section. The recording medium S on which color images are transferred is conveyed to a fixing section 25, and the images are fixed on the medium under the application of heat and pressure. The recording medium S is then delivered by a delivery roller to a delivery section 37 located at a top surface of the apparatus body. It is to be noted that the rotary developing unit 20 and the immobilized black developing unit 21K are constituted respectively to be detachably attached to the body of the image forming apparatus 1. Each section of the image forming apparatus 1 will be described in detail next.

The drum cartridge 13 is constituted in a united body of the image carrier 15, and a cleaning container 14 also serving as a holder for the image carrier 15. The drum cartridge 13 is supported detachably to the apparatus body and can be replaced as a unit basis easily in accordance with the life time of the image carrier 15. In this embodiment, the image carrier 15 is constituted of an aluminum cylinder having a diameter of about 62 mm coated with an organic photo-conductive layer and is rotatively mounted. A cleaner blade 16 serving as a cleaning member, and a primary charging means 17 are disposed on a periphery of the image carrier 15 and are rotatively drive by a drive force from a drive motor, not shown, according to an image formation operation. The cleaning container 14 is as described below.

The primary charging means 17 uses a contact-charging method, in which a conductive roller is made to be in contact with the image carrier 15. The surface of the image carrier 15 can be charged uniformly by the application of a voltage to the conductive roller.

The image carrier 15 is subject to exposure at a scanner section 30. That is, when an image signal is given to a laser diode, the laser diode radiates image light corresponding to the image signal to a polygon mirror 31. The polygon mirror 31 rotates at a high rate by a scanner motor, not shown, and the image light reflected on the polygon mirror 31 selectively expose the surface of the image carrier 15 rotating at a fixed rate through image forming lenses 32 and a reflex mirror 33, thereby forming static latent images on the image carrier.

The developing means is constituted of the rotary developing unit 20 having the respective color developing units, a yellow developing unit 20Y, a magenta developing unit 20M, a cyan developing unit 20C, and a sole black developing unit 21K.

The black developing unit 21K is a secured developing unit. A sleeve 21KS is disposed with a very small space to the image carrier 15 at a position corresponding to the image carrier 15 and forms visible images on the image carrier 15 by black toner. The black developing unit 21K feeds toner in the container by a feeding mechanism, coats the toner as a thin layer on an outer periphery of the sleeve 21KS rotating in a clockwise direction in FIG. 1 by a coating blade 21KB, made in pressed contact with an outer periphery of the sleeve 21KS, and gives electric charges to the toner. When a development bias is applied to the sleeve 21KS, the electrostatic latent image of the image carrier 15 is developed with the toner.

The rotary developing unit 20 is supported detachably to a development rotary member 23 rotating around a shaft 22 as a center, and for forming images, the respective developing units move rotationally around the shaft 22 and stop the rotation at a position such that a predetermined developing unit faces the image carrier 15. After sleeves 2OYS, 2OMS, 20CS are positioned to face the image carrier 15 with a very small space (about 300 $\mu$m), visible images are formed corresponding to the electrostatic latent images on the image carrier 15. When a color image is formed, the developing rotary member 23 rotates as one rotation of the intermediate transfer body 9, and a developing process is done by means of the yellow developing unit 20Y, the magenta developing unit 20M, the cyan developing unit 20C, and the sole black developing unit 21K, in this order, so that each color is transferred to the intermediate transfer body 9 and overlapped at the body 9. After the toner images are transferred onto the intermediate transfer body 9, the developer remainders, which remain on the image carrier 15, or namely the waste toner, are removed by the cleaning means as described below.

FIG. 1 shows a state that the yellow developing unit 20Y is placed and made still at a position that the unit faces to the image carrier unit. The yellow developing unit 20Y feeds the toner in the container to a coating roller 20YR by a feeding mechanism, coats the toner as a thin layer on an outer periphery of the sleeve 20YS rotating in a clockwise direction in FIG. 1 by means of the coating roller 20YR rotating in a clockwise direction in FIG. 1 and a coating blade 20KY, and gives electric charges (triboelectric charges) to the toner. By application of the development bias to the sleeve 20YS facing the image carrier 15 on which latent images are formed, development is made with toner on the image carrier 15 corresponding to the latent images. Image formation for respective colors is made in substantially the same way with respect to the magenta developing unit 20M and the cyan developing unit 20C.

The sleeves 20YS, 2OMS, 20CS of the rotary developing unit are connected to a drive power and respective high voltage sources for the respective colors formed in this printer body when each developing unit moves rotationally to the developing position, and the voltage is selectively and sequentially applied for each color developing unit where each unit is driven.

The intermediate transfer body 9 rotates in the clockwise direction in FIG. 1 in synchrony with the outer peripheral speed of the image carrier 15, and receives multiple transfers by four transfers (images of four colors, CMYK) of visualized toner images on the image carrier 15 by the respective developing units when color images are formed. The intermediate transfer body 9 that received the multiple transfers further transfers the color toner images on the intermediate transfer body 9 at one time onto the recording medium S by conveying the recording medium S through sandwiching the medium S with the transfer roller 10 to which the voltage applies.

The intermediate transfer body 9 according to the embodiment has an aluminum cylinder 12 having a diameter of 186 mm and an outer periphery covered with an elastic layer 11 made of materials such as an intermediate resistance sponge and intermediate resistance rubber. The an intermediate transfer body 9 is rotatively supported and rotates upon transmission of drive force by means of gears, not shown but secured unitedly The recording medium S is stacked on a cassette 2 provided at a lower portion of the apparatus body. The recording medium S, after being fed by a pickup roller 3 and separated by a feeding roller 4 and a retard roller 5 sheet by sheet, is conveyed by guided by a feeding guide 6 and sent to the register roller 8. The register roller 8 does a non-rotation operation that renders the recording medium S in a stop and wait state and a rotation operation that renders the recording medium S conveyed toward the intermediate transfer body 9 according to a prescribed sequence, thereby correcting oblique feeding of the recording medium S and conveying the recording medium S in synchrony with the intermediate transfer body 9.

The transfer roller 10 winding an intermediate resistance foamed elastic body over a metal shaft is provided to be capable of contacting with and separating from the intermediate transfer body 9. While the four color toner images are formed on the intermediate transfer body 9, or while the intermediate transfer body 9 turns multiple times, the transfer roller 10 is located at a position spaced from the intermediate transfer body 9 as shown by a solid line in FIG. 1 so as to keep the images in order. When the recording medium S is conveyed after the color toner images are formed on the intermediate transfer body 9, the transfer roller 10 is urged with a prescribed pressure to the intermediate transfer body 9 through a recording medium S as shown by a broken line by means of a cam not shown.

A bias is also given to the transfer roller 10 at that time, thereby transferring the toner images on the intermediate transfer body 9 to the recording medium S. The intermediate transfer body 9 and the transfer roller 10 are driven respectively, so that the recording medium S is in a state that sandwiched by the intermediate transfer body 9 and the transfer roller 10, is subject to a transfer process and at the same time, is conveyed at a prescribed rate toward the fixing section 25 as the subsequent process.

The fixing section 25 is for fixing the toner images transferred on the recording medium S and includes a fixing roller 26 for applying heat, and a pressure roller 27 for pressing the recording medium S to the fixing roller 26. The respective rollers 26, 27 are hollow rollers and have respective heaters 28, 29 inside, thereby conveying the recording medium S upon being rotatively driven.

That is, the recording medium S holding toner images is conveyed by the fixing roller 26 and the pressure roller 27, and when heat and pressure are applied, the toner images are fixed on the recording medium S. The recording medium S to which the images are fixed is conveyed by a conveyance roller 34 and a conveyance roller 35 and is delivered to the delivery section 37 by a delivery roller 36 to be stacked, thereby finishing the image formation.

[Process Cartridge]

Referring to FIG. 2, the drum cartridge 13 as a process cartridge according to the invention is described next. The drum cartridge 13 as described above is constituted of an image carrier 15, and a cleaning container 14 for accumulating in the cleaning container 14 waste toners removed from the image carrier 15.

Cleaning processing is made by the cleaner blade 16 attached to the cleaning container 14 and a cleaning blush not shown. The waste toners on the image carrier 15 enter in the cleaning container 14 by going by a scooping sheet 18, and are scraped by first the cleaning brush and then the cleaner blade 16. The scraped waste toners are scooped up by the scooping sheet 18 and collected in the cleaning container 14. The cleaning container 14 may not be filled with the waste toner accumulated in the container 14 earlier than the life time of the image carrier 15, so that the cleaning container 14 can be replaced together at a time of replacement of the image carrier 15 when reaching the life time.

In the cleaning container 14, a support member 16*b* is so secured at a front surface of the cleaning container 14 by securing members 40 such as screws or the like that an elastic contacting portion 16*a* of a tip of the cleaner blade 16 is in contact with the image carrier 15 with a prescribed entering amount.

A sealing member 41 for preventing the waste toners from leaking out of the cleaning container 14 is attached on each opposite side of the cleaner blade 16 on the cleaning container 14 as to contact the image carrier 15. As a sealing member 41, it is preferable that the surface contacting with the image carrier 15 has sealing property and sliding property, and in this embodiment, a fabric member, in which a PTFE fiber is formed in a pile shape, is used as the sealing member. The sealing member can be any material as long as it has the required sealing property and sliding property so that, for example, a fabric member of an electrostatic transplant, felt, or the like may be used. To prevent the sealing property from being impaired, the sealing member preferably has a double-layered structure in which a cushion material, such as foamed urethane or the like, is provided on the back surface of the sealing member.

A contacting roller 42 serving as a distance-ensuring means, manufactured with high accuracy, is disposed at a position corresponding to each end of the image carrier 15, and is rotatively supported around a roller shaft 42*a*. The contacting roller 42 is in contact with the image carrier and the sleeves 20YS, 20MS, 20CS, and 21KS and ensures the prescribed distance between the image carrier and the sleeves.

The sealing member 41 is molded as to extend up to the opposite end of the image carrier 15, and includes a sealing portion 41*a* serving as a seal, and an extended portion 41*b*. Therefore, the sealing portion 41*a* functions as to prevent the waste toners from leaking out, and the extended portion 41*b* is in contact with the contacting surface 15*a* on the image carrier 15 contacting to the contacting roller 42 and cleans the contacting surface. Accordingly, even where foreign objects, such as scattered toners, are attached between the contacting roller 42 and the contacting surface 15*a*, the surface can always keep the state by wiping the surface with the extended portion 41*b*, so that the apparatus can maintain the distance between the image carrier 15 and the sleeve.

Because the extended portion 41*b* is in a united body with the sealing portion 41*a*, there is no space between the sealing member and the cleaning member, so that the image carrier may not have any space on which scattered toners remain. The number of parts to be attached is further reduced, so that the process cartridge can reduce the manufacturing process and the costs for parts and can improve the productivity as well.

Figure 3:
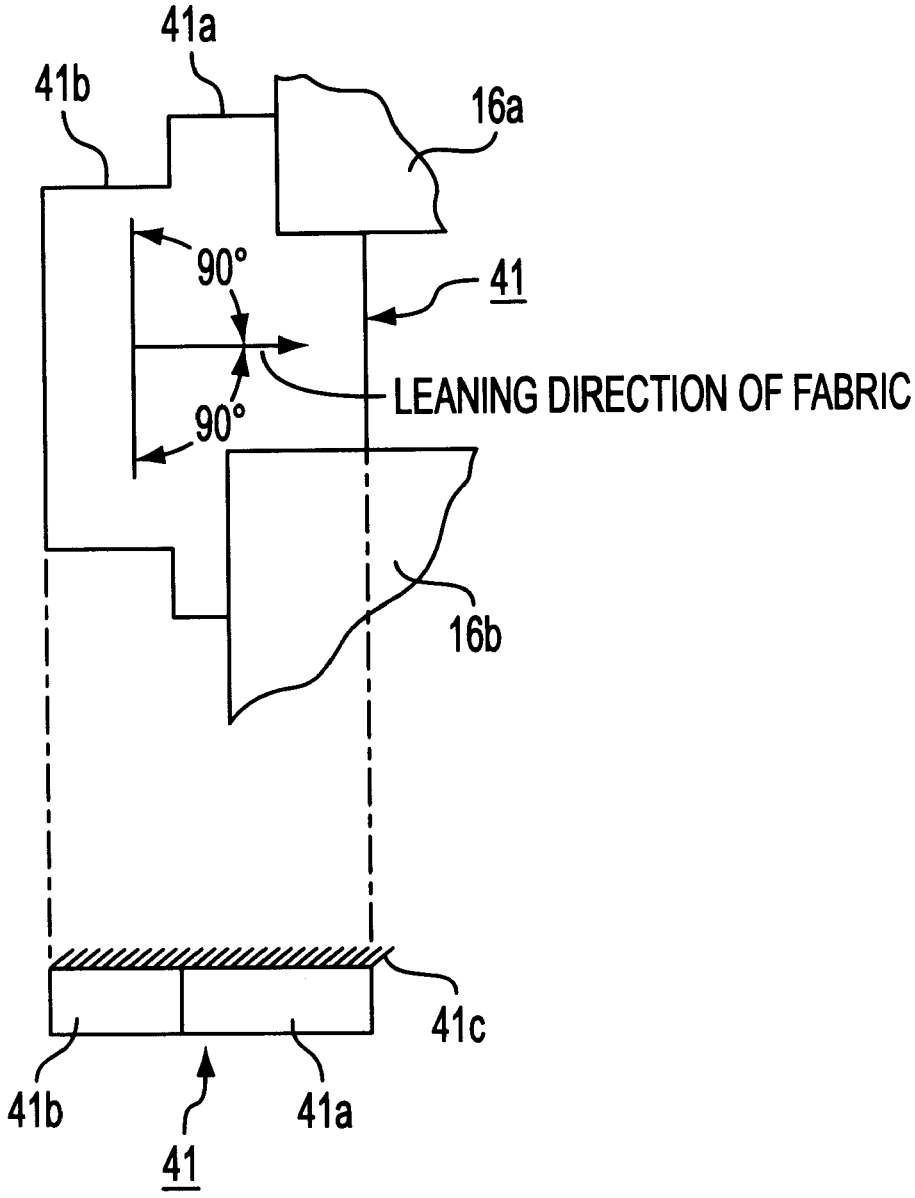
FIG. 3 is a side view of a sealing member.
Figure 4:
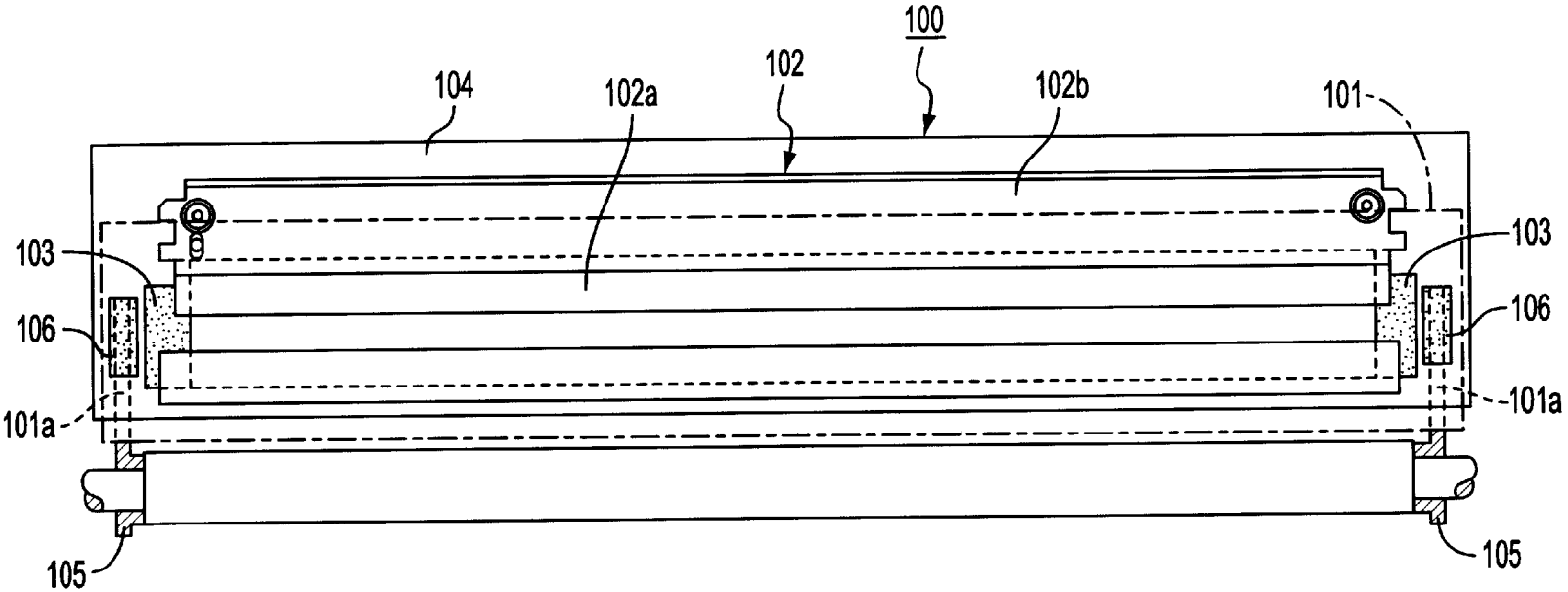
FIG. 4 (PRIOR ART)
FIG. 4 is a front view showing a conventional process cartridge.

With the above embodiments, the fabric member is used as the sealing member 41, and the form of the fabric member is illustrated in reference to FIG. 3. FIG. 3 shows a plan view and side view of the fabric member, and the plan view located above shows a part in FIG. 2 in an enlarged view. Numeral 16*b* in the plan view is a receiving sheet for toner made of a thin film sheet, and the sheet is attached and secured below the blade 16*a* of the cleaning housing 14. That is, the toner scraped by the blade 16*a* are guided and collected by the receiving sheet into the cleaning housing.

Innumerous fabrics 41*c*, constituting the fabric member, are inclined toward the opening made of the blade 16*a* of the housing, the sealing member 41, and the receiving sheet 16*b*, as shown in the side view located below in FIG. 3. A permissive range of the inclined state may be, as shown in this plan view, as far as within 90° with respect to the opening side, and preferably, within 45° to 60°, which would be no problem.

The effects for preventing the toner from scattering and for cleaning portions corresponding to the roller of the developing roller can be adequately accomplished where the fabric member 41 is inclined toward the opening and where the inclined direction is within the above range even if shifted.

Particularly, where the fabric member is inclined, the toners about to scatter from the opening side can be captured, and at the same time, the inclined fabrics can improve the above cleaning effect.

It is to be noted that as another example equivalent to the above roller 42, the roller shaft 42*a* in FIG. 2 and as a developing roller, a spacer formed on each opposite end of the roller 42 may be used. In addition, a spacer member or members provided to a charger, a transfer unit, or an intermediate transfer unit around the vicinity of the image carrier when necessary are very useful.

The sealing member disposed on each opposite end of the cleaning means is structured to extend to a surface to which a distance-ensuring means disposed on the image carrier contacts, to clean it, and therefore, in comparison with a structure that a cleaning member, for cleaning the contact surface of the distance ensuring means, is newly added, no slight gap (uncleaned area) may be otherwise provided between the sealing member and this cleaning means, so that the scattered toner clinging to that portion could further completely eliminate a worrisome mess on the transfer roller, serving as the transfer means, and ends of the transfer materials.

Since the sealing member (cleaning member) covers entirely an interval between the cleaning means and the distance-ensuring means, the cleaning distance to the distance-ensuring means can be used most effectively, and the cleaning means can be utilized as a cleaning means having a longer life time.

The above structure has separated functions for substantially preventing leaks and for cleaning, so that a longer life time can be provided.

Since the sealing member and the cleaning member are made in a united body, assembling of the members can be made simpler, and this can reduce the costs for assembling and mistakes such as the assembling being made negligently without necessary parts.

What is claimed is:

1. A cleaning apparatus for cleaning an image carrier, comprising:

a cleaning member for removing a remaining developer left on said image carrier; and a sealing member for preventing the developer from leaking out at end portions of said cleaning member, said sealing member having a fabric member contacting an area of said image carrier, which a distance ensuring member, for maintaining a prescribed distance between a developer carrier for carrying the developer and said image carrier, contacts in the longitudinal direction of said image carrier, wherein the leaning direction of fabric on said fabric member is a direction from an end portion to a center portion of said cleaning member when viewed from upstream of said fabric member in a moving direction of said image carrier.

2. A cleaning apparatus according to claim 1, wherein the leaning direction of the fabric is set in a range of ±45 to ±60 degrees from direction from an end portion to a center portion of said cleaning member, from a viewpoint of a plane substantially parallel to a face where said fabric member is supported by a frame of said cleaning apparatus.

3. A process cartridge detachably mountable to a main assembly of an image forming apparatus, comprising:

an image carrier;

a developer carrier to carry developer for developing an electrostatic image formed on said image carrier with the developer;

a distance ensuring member to contact said image carrier for maintaining a prescribed distance between said developer carrier and said image carrier, a cleaning apparatus for removing a remaining developer left on said image carrier; and a sealing member for preventing the developer from leaking out at end portions of said cleaning member, said sealing member having a fabric member contacting an area of said image carrier, which said distance ensuring member contacts in the longitudinal direction of said image carrier, wherein the leaning direction of fabric on said fabric member is a direction from an end portion to a center portion of said cleaning member when viewed from upstream of said fabric member in a moving direction of said image carrier.

4. A process cartridge capable of being incorporated in an image forming apparatus according to claim 3, wherein the leaning direction of the fabric is set in a range of ±45 to ±60 degrees from the direction from an end portion to a center portion of said cleaning member, from the viewpoint of a plane substantially parallel to a face where said fabric member is supported by a frame of said cleaning apparatus.

5. An image forming apparatus, comprising:

an image carrier;

a developer carrier to carry developer for developing an electrostatic image formed on said image carrier with the developer;

a distance ensuring member to contact said image carrier for maintaining a prescribed distance between said developer carrier and said image carrier, a cleaning member for removing a remaining developer left on said image carrier; and a sealing member for preventing the developer from leaking out at end portions of said cleaning member, said sealing member having a fabric member contacting an area of said image carrier, which said distance ensuring member contacts in the longitudinal direction of said image carrier, wherein the leaning direction of fabric on said fabric member is a direction from an end portion to a center portion of said cleaning member when viewed from upstream of said fabric member in a moving direction of said image carrier.

6. An image forming apparatus according to claim 5, wherein the leaning direction of the fabric is set in a range of ±45 to ±60 degrees from the direction from an end portion to a center portion of said cleaning member, from the viewpoint of a plane substantially parallel to a face where said fabric member is supported by a frame of said cleaning apparatus.

* * * * *

UNITED STATES PATENT AND TRADEMARK OFFICE

CERTIFICATE OF CORRECTION

PATENT NO. : 6,178,301 B1
DATED : January 23, 2001
INVENTOR(S) : Hisayoshi Kojima et al.

It is certified that error appears in the above-identified patent and that said Letters Patent is hereby corrected as shown below:

Title page,
Item [57] ABSTRACT:
Line 4, "means" should read -- member --.
Line 7, "device" should read -- device, --.

Column 1,
Line 28, "toners")" should read -- toner") --.
Line 50, "toners." should read -- toner. --.
Line 65, "magnetic brush" should read -- magnetic-brush --.

Column 2,
Line 10, "surface 1O1a," should read -- surface 101a, --.

Column 3,
Line 31, "rotatively drive" should read -- rotatively driven --.
Line 39, "subject" should read -- subjected --.
Line 45, "expose" should read -- exposes --.

Column 4,
Line 6, "2OYS," should read -- 20YS, --.
Line 7, "2OMS," should read -- 20MS, --.
Line 23, "to" should be deleted.
Line 38, "2OMS," should read -- 20MS, --.
Line 61, "and" should read -- and an --, and after "The", "an" should be deleted.
Line 64, "unitedly" should read -- unitedly. --.

Column 5,
Line 3, "by guided" should read -- and guided --.
Line 32, "subject" should read -- subjected --.
Line 55, "toners" should read -- toner --.
Line 58, "blush" should read -- brush --.
Line 59, "toners" should read -- toner --.
Line 62, "toners are" should read -- toner is --.

UNITED STATES PATENT AND TRADEMARK OFFICE

CERTIFICATE OF CORRECTION

PATENT NO. : 6,178,301 B1
DATED : January 23, 2001
INVENTOR(S) : Hisayoshi Kojima et al.

It is certified that error appears in the above-identified patent and that said Letters Patent is hereby corrected as shown below:

Column 6,
Line 2, "the life" should read -- its life --.
Line 9, "toners" should read -- toner --.
Line 12, "as" should read -- so as --.
Line 37, "toners" should read -- toner --.
Line 41, "toners," should read -- toner, --.
Line 49, "toners remain." should read -- toner remains. --.
Line 62, "are" should read -- is --.
Line 64, "Innumerous" should read -- Numerous --.

Column 7,
Line 13, "toners" should read -- toner --.
Line 26, "contacts," should read -- contacts it, --.
Line 28, "distance ensuing" should read -- distance-ensuring --.

Column 8,
Line 3, "direction" should read -- the direction --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*